US006164654A

United States Patent [19]

Tricomi

[11] Patent Number: 6,164,654

[45] Date of Patent: Dec. 26, 2000

[54] STACKING GAME OF BALANCE AND DEXTERITY

[76] Inventor: Anthony Tricomi, 8629 W. Summerdale, Chicago, Ill. 60656

[21] Appl. No.: 09/203,781

[22] Filed: Dec. 2, 1998

[51] Int. Cl.[7] ..... A63F 7/00

[52] U.S. Cl. ..... 273/450; 273/DIG. 24; 273/449

[58] Field of Search ..... 273/449, 440, 273/445, 446, 450, 459, DIG. 24; 446/69, 85, 219

[56] References Cited

U.S. PATENT DOCUMENTS

| | | | |
|---|---|---|---|
| 3,712,616 | 1/1973 | Goldfarb et al. | 273/449 X |
| 4,135,715 | 1/1979 | Soulos | 273/446 X |
| 4,149,717 | 4/1979 | Seijiro | 273/440 |
| 4,522,393 | 6/1985 | Dunn . | |
| 4,753,622 | 6/1988 | Nakama | 446/85 |
| 4,902,010 | 2/1990 | Davis et al. . | |
| 5,067,729 | 11/1991 | Hunter et al. . | |
| 5,785,320 | 7/1998 | Borg . | |
| 5,848,926 | 12/1998 | Jardetzky et al. | 446/85 |

OTHER PUBLICATIONS

Game package labels and instructions by Patience, Inc., Copyright 1989.

*Primary Examiner*—Raleigh W. Chiu

*Attorney, Agent, or Firm*—Gardner, Carton & Douglas

[57] ABSTRACT

The present invention provides a game that challenges variable skill levels, variable skill attributes, and that may be played under variable lighting conditions. The present invention provides a game of balance and dexterity, whereby game pieces 10 are stacked one atop the other. The balancing surface of a game piece may be varied in size, so that players of different skill levels would find the game equally challenging. The game pieces are designed to glow in the dark. Therefore, the game may be played in a well-lit room, in a completely darkened room, or in a semi-darkened room. The game of the present invention may be played in a specified amount of time. In the preferred embodiment, each game piece 10 is in the shape of a truncated prism, with the apex 16 of the truncated prism lying along a longitudinal axis of the game piece 10. The end elements 12, 12*a* of the game piece 10 define a triangle, with the base 22 of each triangle lying perpendicular to the longitudinal axis of the game piece 10. Each end element 12, 12*a* may lie in a plane which is perpendicular to the base 18 of the game piece 10 or each end element 12, 12*a* may lie at an angle that is lesser than or greater than 90 degrees with respect to the base 18 of the game piece 10.

7 Claims, 3 Drawing Sheets

STACKING GAME OF BALANCE AND DEXTERITY

FIELD OF THE INVENTION

This invention relates to games of eye-hand coordination and skill.

BACKGROUND OF THE INVENTION

Games based upon the balancing of objects are known. One game is based upon the balancing of dissimilar shaped blocks, for example. The blocks are stacked one atop the other in sequence until the construct topples or no more blocks can be added. Yet another game is based upon the stacking of blocks having a trapezoidal cross-section. An elongate slot is disposed through the side of each block, such that the stacking of the blocks can also be facilitated by insertion of a rod through the elongate slot. Each of these games is characterized by a stacking of a block, a brick, a shape, or, generally, a game piece, one atop the other.

Another class of games involves the stacking of game pieces to form a tower. Such games are played by first building the tower and then removing the game pieces. In one such game, the game is played by building a tower of bricks in multiple levels. Players remove a brick from one level and add it to the top of the tower to build new levels until collapse of the tower occurs.

In yet another game, pieces in the shape of blocks are stacked in a crisscrossed pattern to form a tower. The blocks are composed of material which has a weight and sliding characteristic which permits them to be easily removed from the tower. The blocks are then pulled out one at a time from anywhere below the existing top layer of the tower and then placed back atop the tower. This process continues until the tower collapses.

In each of the aforementioned games, the game pieces are typically rectangular in shape, although other geometries are known. For example, one game involves the stacking of game pieces where each game piece has a different geometry.

One problem with these conventional balancing or stacking games is that they do not provide the means to change the degree of difficulty of performing the game with respect to a single game piece geometry. Such conventional games are only suitable to a single group having a particular skill level. Therefore, these games are typically used by a narrow age group.

Yet another problem with such conventional games is that the games typically require only one type of skill to play and, thus, challenge only one skill attribute. For example, a conventional game may be based only on the balancing of game pieces. Alternatively, a conventional game may be based on the selective removal of game pieces while maintaining the balance of the remaining stacked game pieces. Additionally, conventional balancing skill games are designed to be played in a well lit room. In each case, only one skill attribute is challenged by the game.

The use of containers for containing game pieces when a game is not in use is known in the art. Typically, such containers consist of boxes or bags into which game pieces, and game instructions, are included. A drawback of such containers, however, is that the game pieces are contained in a loose arrangement. Thus, often the game pieces may be chipped are otherwise damaged when the container is moved or transported to a playing area. This is a particular drawback to players of a stacking game where the ability to balance a game piece may be seriously compromised by a damaged game piece. Also, because the game pieces are stored loose, it is not always apparent to a player if a game piece is missing until the game is in play. Another drawback of such containers is that individual game pieces are not always easily accessible. A player may damage a game piece in attempting to retrieve a single game piece from the loose collection of game pieces in the container. Furthermore, because the game instructions are stored loose, it is not always apparent to a player if the instructions are missing until the game is in play.

Each of the above prior art games has to some extent proven limited. What would therefore be advantageous would be a game that offered a challenge to variable skill level groups. It would be further advantageous to have a game that challenged not one, but many skill attributes. It would also be an advantage to provide a game kit which would contain game pieces when a game was not in use such that the game pieces would not become damaged. It would be an even further advantage to provide a game kit which would contain game pieces and instructions in a manner that would make it apparent when any of the game piece or instructions were missing.

SUMMARY OF THE INVENTION

The present invention provides a game that challenges variable skill levels. The present invention also provides a game that challenges variable skill attributes. The present invention provides a game of balance and dexterity, whereby game pieces are stacked one atop the other.

The game of the present invention can challenge different skill levels. The balancing surface of a game piece may be varied in size, so that players of different skill levels would find the game equally challenging. The game pieces of the game of the present invention are designed to glow in the dark. Therefore, the game of the present invention may be played in a well-lit room, it may be played in a completely darkened room, or it may be played in a semi-darkened room. Accordingly, the present invention provides a game that may be played under variable lighting conditions thus providing further means to challenge different skill levels.

The game of the present invention may be played in a specified amount of time. Thus, not only does the game challenge a player's ability to balance the game pieces, but it also challenges the player's ability to stack the game pieces before a specified amount of time expires. Accordingly, the game of the present invention challenges different skill attributes.

The present invention provides a game kit which is adapted to store game pieces and game instructions. The present invention provides a game kit which stores game pieces and thus prevents damage to the game pieces. The present invention also provides a game kit whereby a missing game piece or a missing instruction will be readily apparent to a player.

DETAILED DESCRIPTION OF THE INVENTION

Figure 1:
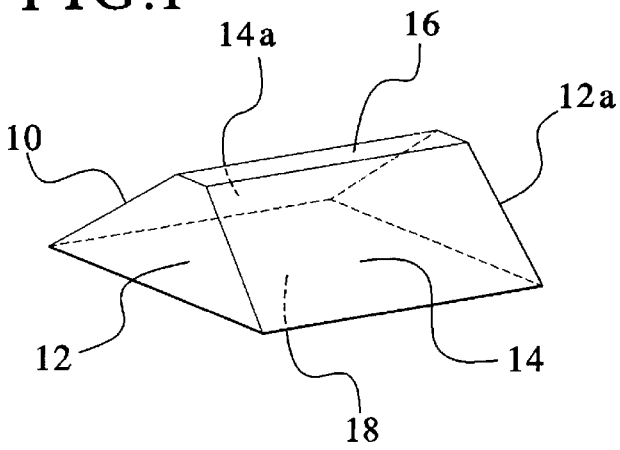
FIG. 1 is a schematic of a game piece made in accordance with the principles of the present invention.

Referring to FIG. 1, a game piece made in accordance with the principles of the present invention is designated by 10. In the preferred embodiment, five game pieces are constructed of a clear plastic material. However, other materials of construction, such as a translucent plastic may also be used. Examples of clear plastics include polycarbonate, polystyrene, polymethylmethacrylate, polymethacrylate butadiene styrene, chlorinated polyvinylchloride, polyvinylidene chloride, and polyvinylidene fluoride. Examples of translucent plastics include low density polyethylene, polybutylene, and high density polyethylene. The pieces are all of approximately the same size and shape. The shape of each game piece 10 is generally pyramidal with the apex 16 of each pyramid forming a balancing surface. Each apex 16 may be further defined as a point or as a plane. In the latter case, the game piece 10 has the shape of a truncated pyramid or prism. The game piece 10 includes two end elements, 12, 12*a,* two side elements, 14, 14*a,* and a base 18.

Figure 2:
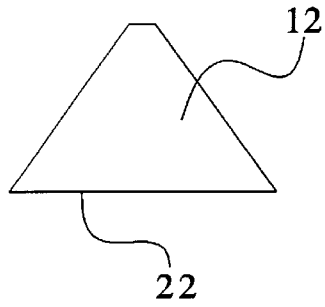
FIG. 2 is an end-view of the game piece of FIG. 1.
Figure 3:
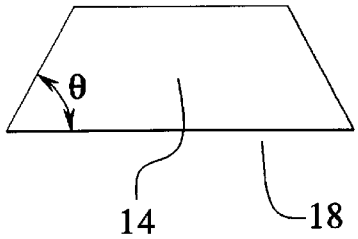
FIG. 3 is a side-view of the game piece of FIG. 1.

In the preferred embodiment, each game piece 10 is in the shape of a truncated prism, with the apex 16 of the truncated prism lying along a longitudinal axis of the game piece 10. The end elements, 12, 12*a,* of the game piece 10 define a triangle, as depicted in FIG. 2, with the base 22 of each triangle lying perpendicular to the longitudinal axis of the game piece 10. Each end element, 12, 12*a*, may lie in a plane which is perpendicular to the base 18 of the game piece 10 or each end element, 12, 12*a*, may lie at an angle that is lesser than or greater than 90 degrees with respect to the base 18 of the game piece 10. In the preferred embodiment, the end elements, 12, 12*a*, of each game piece 10 lie at an angle that is slightly less than 90 degrees, with respect to the base 18 of the game piece 10, such that the end elements, 12, 12*a*, of each game piece 10 are slanted inward towards the center of the game piece 10. The angle formed by an end element, 12, 12*a*, with the base 18 is depicted as θ in FIG. 3. FIG. 3 illustrates a side element 14 with θ defined with respect to the base 18 such that θ defines an angle which is less than 90°. The angle θ preferably lies between 20° and 80° with respect to the base 18.

Figure 4:
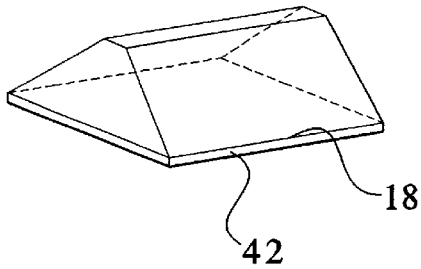
FIG. 4 is an isometric view of the game piece of FIG. 1.

The game piece 10 may be solid or it be constructed from components such that the interior of the game piece 10 is hollow. In this case, the elements described above are the components from which the game piece 10 is made. The hollow interior may be completely encased by the components forming the game piece 10. Alternatively, the hollow interior may be partially encased. In the preferred embodiment, each game piece 10 is a solid. However, even in the case where the game piece 10 is a solid, a component may be added to the game piece as illustrated in FIG. 4. FIG. 4 depicts a component 42 forming part of the base 18 of the game piece 10.

In the preferred embodiment described above, the base 18 of each game piece 10 defines a rectangle. This base 18 provides, then, yet another balancing surface for the game piece 10. Accordingly, each game piece has at least two balancing surfaces.

Figure 5:
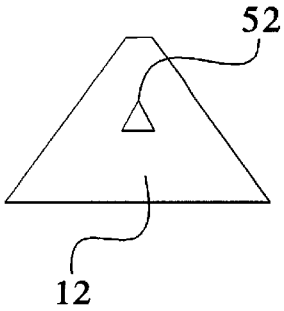
FIG. 5 is an end-view of the game piece of FIG. 1.
Figure 6:
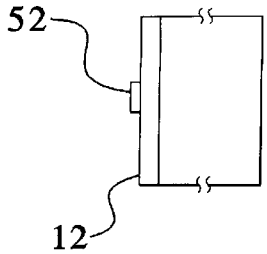
FIG. 6 is a side-view of the game piece element of FIG. 5.

The end elements, 12, 12*a*, of each game piece 10 may define simple planar surfaces. Each end element, 12, 12*a*, may have disposed on its surface either a member raised above the surface of end element, 12, 12*a*, or a member recessed below the surface of end element, 12, 12*a*. Such a member may be used to facilitate gripping of the game piece 10. In the preferred embodiment, illustrated in FIG. 5, a triangular shaped raised member 52 is disposed on the surface of each end element, 12, 12*a*. FIG. 6 depicts a side view of end element 12 showing raised member 52 in profile.

While a game piece 10 has been described as being generally pyramidal in shape, game piece 10 in the preferred embodiment is in the shape of a prism. Plus, in the preferred embodiment, each game piece 10 also has all of the attributes of a prism, including internal reflectivity and internal refractivity.

Each game piece 10 is further manufactured to incorporate a glow-in-the-dark feature. In the preferred embodiment, the glow-in-the-dark element forms the base 18 of the prism. In this way, all of the attributes of the prism are taken advantage of with respect to the glow-in-the-dark feature, such that, there is an enhancement of the glow-in-the-dark feature by virtue of the prism shape. Such methods of manufacture include incorporating luminescent material into the materials of construction of the game piece, incorporating a light source into the game piece, or incorporating other means to impart a glow-in-the-dark characteristic.

Luminescence is the emission of light by, in one instance, a chemical process. Luminescence may be further defined to include chemiluminescence, phosphorescence and fluorescence. Chemiluminescence is the emission of light from a chemical process whereby light is emitted during the course of a chemical reaction. Phosphorescence is luminescence that is caused by the absorption of an incident radiation at one wavelength followed by delayed reradiation at a different wavelength. Phosphorescence continues for a noticeable time after the incident radiation stops. Fluorescence is luminescence that is caused by the absorption of an incident radiation at one wavelength followed by the nearly immediate reradiation at the same or a different wavelength. Fluorescence typically ceases when the incident radiation stops. Radiation in the preferred embodiment is visible light.

The glow-in-the-dark feature may be provided by a luminescent material and manufactured using any of the known methods for imparting chemiluminescent characteristics. One such luminescent material is CYALUME, a chemiluminescent material (American Cyanamid Company, Parsippany, N.J.). The material CYALUME is a solution of a peroxide, a phthalic ester, a phenyl oxalate ester and a fluorescent dye. Furthermore, the chemiluminescent material may be selected to provide a particular color of emitted light. For example, the material CYALUME may provide blue, yellow or green fluorescence based on the formulation used. Where the CYALUME material provides a yellow-green fluorescence, the fluorescent dye is 9,10-bis (phenylethynyl)anthracene.

Other chemiluminescent materials are known. One such example is the composition containing a styrene derivative, an oxalate ester, a peroxide, and a fluorescent dye. Yet a further example is a bi-component sheet which includes a metal foil laminated to a translucent polyolefin film. The interstitial space between the foil and the film contains a solution of an oxalate and, optionally, a fluorescent dye. Other means for achieving chemiluminescence may also be used.

The glow-in-the-dark feature may also be achieved by means other than the use of luminescent materials and methods. For example, the glow-in-the-dark feature may be achieved by incorporating a light emitting diode, or other light generating device, into a game piece. In this way, when the light generating device is activated to give off light, the game piece will acquire a glow-in-the-dark feature.

In the preferred embodiment, the glow-in-the-dark feature is a phosphorescent material incorporated into a glow-in-the-dark component. The glow-in-the-dark feature is imparted to component 42 by incorporating PERMAGLOW CP-05 green color concentrate (Hirotec, Inc., Santa Ana, Calif.) into the materials of construction of base 18. Other color concentrates, such as blue, may be selected. The color concentrate may be incorporated into the material from which the game piece 10, the component 42, the end element, 12, 12*a*, the side element, 14, 14*a*, or the base 18 is made.

In the preferred embodiment, the glow-in-the-dark feature of a game piece is further characterized by an afterglow decay process. The afterglow decay process is the process by which the light emitted from the glow-in-the-dark material decreases as a function of time. In this case, time is measured from the initiation of light emission from the glow-in-the-dark material. Typically, the afterglow decay process is used to describe phosphorescence.

The afterglow decay process is further described by a first and second Lambert-Beer's Law decay constant. In the preferred embodiment, the glow-in-the-dark feature has a first Lambert-Beer's Law decay constant of about 1.2 to about 1.4 corresponding to a first afterglow decay process step and a second Lambert-Beer's Law decay constant of about 0.6 to about 0.8 corresponding to a second afterglow decay process step.

Figure 7:
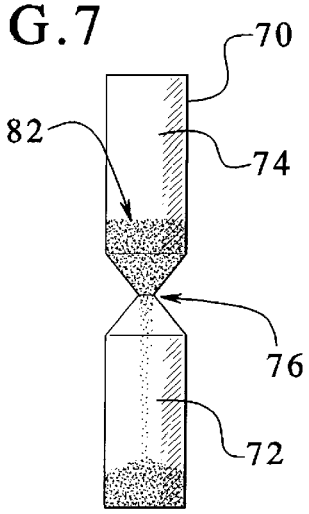
FIG. 7 is a schematic of a timer made in accordance with the principles of the present invention.

Also included with the game is a timer such that the game may be played within a preset time limit. As depicted in FIG. 7, the timer 70 includes an upper chamber 74, an orifice 76, and a lower chamber 72. In the preferred embodiment, the timer 70 takes the form of an hour glass where time is counted by the amount of time it takes an amount of particulate material, or sand-like particles 82, to flow from the upper chamber 74 through the orifice 76 into the lower chamber 72. The sand-like particles 82 may in fact be sand that has been coated with luminescent material. In the preferred embodiment, the timer 70 is manufactured from a translucent material which has disposed therein a luminescent material, such as PERMAGLOW CP-05. In the preferred embodiment, the sand-like particles 82 are black in color. Accordingly, in the preferred embodiment, the black sand-like particles 82 appear as a shadow within the glow-in-the-dark timer 70.

Figure 9:
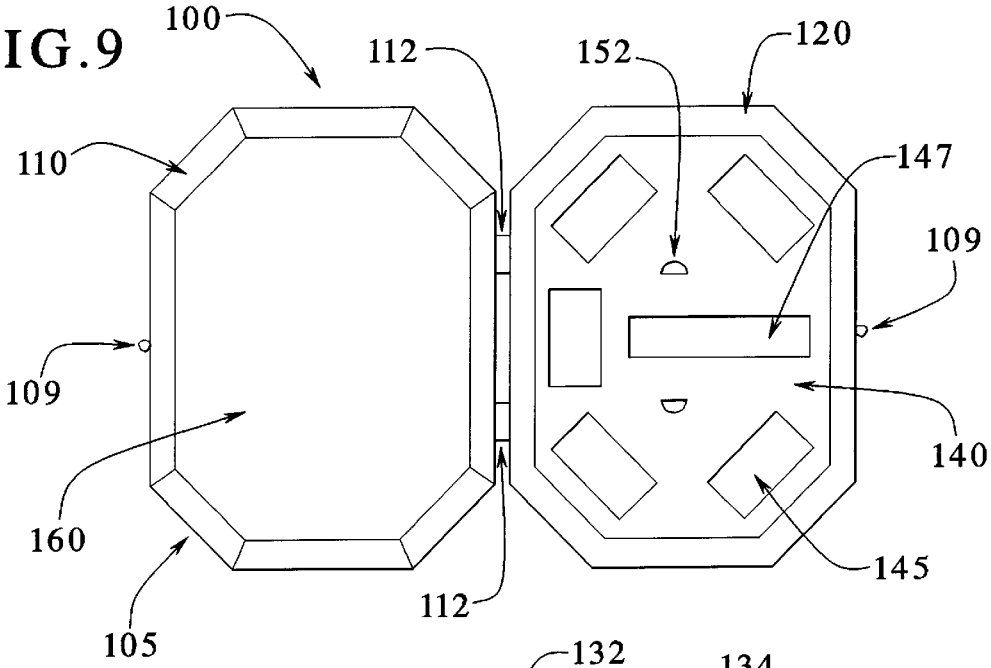
FIG. 9 is a schematic depicting the game kit made in accordance with the principles of the present invention.

Referring to FIG. 9, a schematic view of a game kit 100 made in accordance with the principles of the present invention is depicted. The game kit 100 includes a container 105. The container 105 includes a top 110 and a bottom 120. Both the top 110 and the bottom 120 are concave in shape and of approximately equal size and shape. The top 110 and the bottom 120 may by used as two separate pieces, or the top 110 may be connected to the bottom 120 employing connection means. Connection means may include a hinge, a living hinge, or other hinged arrangement allowing relative movement of the top 110 and the bottom 120 while maintaining the top 110 connected to the bottom 120. In the preferred embodiment, the top 110 is connected to the bottom 120 by a hinge 112. The bottom 120 is adapted to accept an insert 140. The insert 140 has disposed therein pockets 145 adapted to accept the game pieces 10, and a well 147 disposed therein adapted to accept the timer 70. Grips 152 are provided to allow for easy removal of the insert 140 from the bottom 120. The top 110 is adapted to accept an instruction booklet 160. Alternately, the bottom 120 is adapted to accept an instruction booklet 160. Thus, the container 105 is adapted to receive an instruction booklet 160. The container 105 of the present invention is preferably made of a clear material to showcase the game pieces. In the preferred embodiment, the container 105 is made of a rigid, clear, lightweight material such as plastic.

The top 110 may be rotated about the hinge 112 to contact the bottom 120. The top 110 has disposed at one edge closure means. Closure means 109 may include a hook and loop fastener or pins disposed on the top 110 and the bottom which frictionally engage, or other means for maintaining container 105 in a closed position. In the preferred embodiment, the top 110 and the bottom 120 each have disposed at one of edge a pin 109. With the top 110 rotated about the hinge 112 to contact the bottom 120, the pins 109 fixedly engage each other to maintain the container 105 in a closed position.

Figure 10:
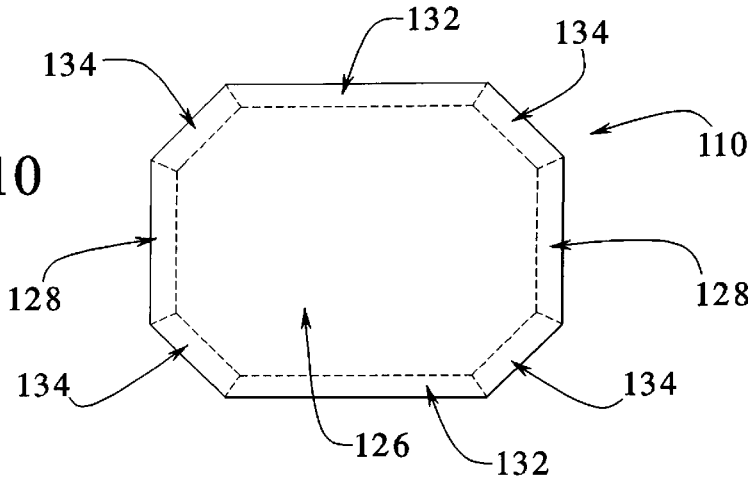
FIG. 10 is a schematic depicting the top of the game kit container of FIG. 9.
Figure 11:
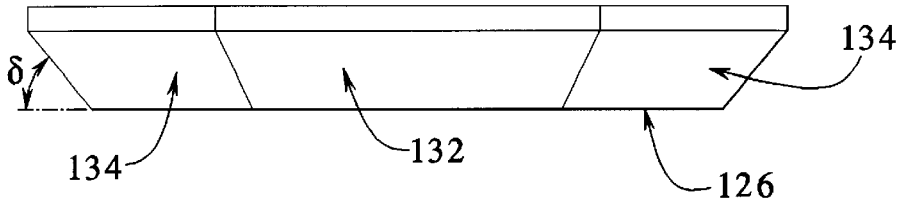
FIG. 11 is a schematic depicting a side elevation of the top of the game kit container of FIG. 10.

Referring to FIG. 10, the top 110 of container 105 defines a concave shape further defined by end elements 128 and 132, side elements 134, and inner plane 126. Referring to FIG. 11, end elements 132, and side elements 134 lie at an angle δ with respect to inner plane 126. Angle δ is selected to be between 10° and 80°. End element 128, not shown in FIG. 11, is similarly oriented with respect to inner plane 126. Each end element 128 is similarly configured to end elements 132. Thus top 110 defines a concave shape.

Figure 12:
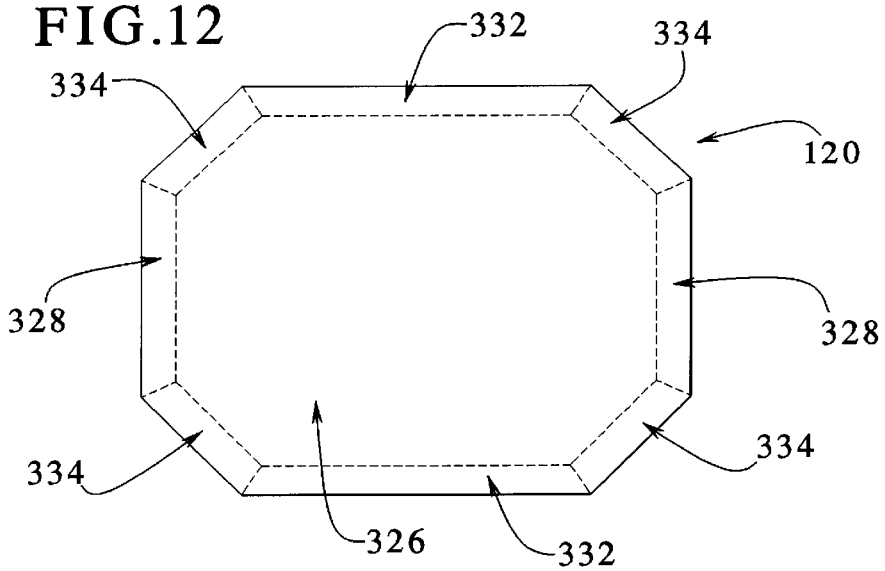
FIG. 12 is a schematic depicting the bottom of the game kit container of FIG. 9.
Figure 13:
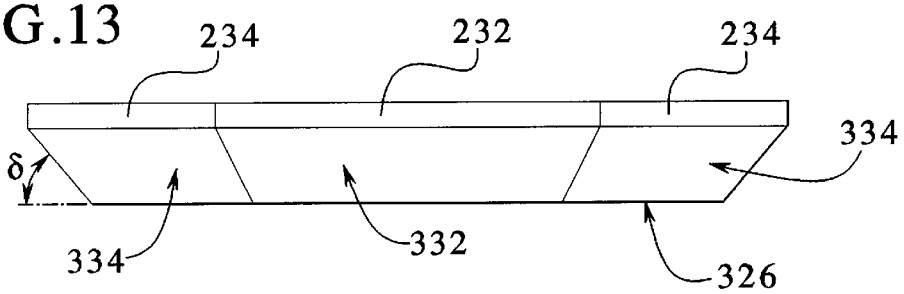
FIG. 13 is a schematic depicting a side elevation of the bottom of the game kit container of FIG. 12.

The bottom 120, shown in FIG. 12, of container 105 is preferably configured as the mirror image of top 110. Thus bottom 120 defines a concave shape further defined by end elements 328 and 332, side elements 334, and inner plane 326. End elements 332, and side elements 334 lie at an angle δ, as shown in FIG. 13, with respect to inner plane 326. Angle δ is selected to be between 10° and 80°. End element 328, not shown in FIG. 13, is similarly oriented with respect to inner plane 326. Furthermore, each end element 332 includes a first near vertical element 232 disposed at the end of the end element 332 farthest from the inner plane 326. Thus the first near vertical element 232 lies approximately perpendicular to the inner plane 326. Each end element 328 is similarly configured to the end elements 332 to include a second near vertical element 228 (not shown). Each side element 334 includes a third near vertical element 234 disposed at the end of end element 334 farthest from inner plane 326.

Figure 14:
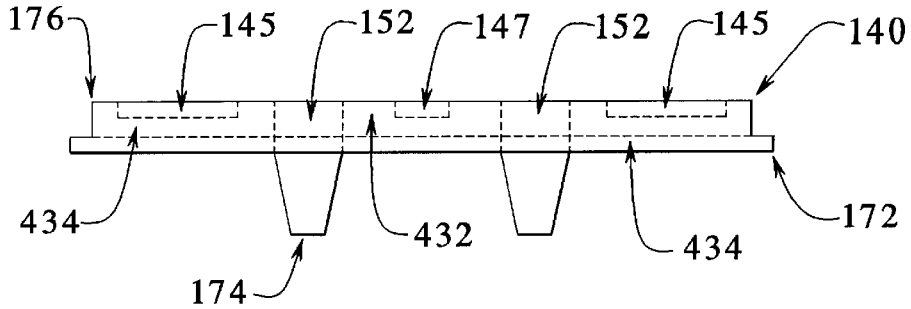
FIG. 14 is a schematic depicting the game kit insert made in accordance with the principles of the present invention.

Referring to FIG. 14, an insert 140 defines a lip 172, legs 174, grips 152, and a tray 176. The lip 172 further defines elements 428 (not shown), 434 and 432. Elements 428, 434 and 432 are adapted to rest on end elements 328, 332 and side elements 334, respectively, and abut elements 228, 234, and 232, respectively. Thus insert 140 is securely held by bottom 120.

The game kit 100 includes the container 105, the insert 140, the timer and the game pieces. The container 105 includes the top 110 and the bottom 120. Insert 140 is contained in bottom 105. The game pieces 10 are contained in pockets 145 of the insert 140. The timer 70 is contained in well 147 of the insert 140. Pockets 145 are adapted to receive and contain game pieces 10 in a secure position when the container 105 is in a closed position. Similarly, well 147 is adapted to receive and contain the timer 70 in a secure position when the container 105 is in a closed position.

The object of the game is to stack and balance as many of the game pieces 10 as possible, one on top of another. A further object of the game is to stack and balance as many game pieces 10 so that the stack does not collapse before a specified time period expires. One such specified time period is the time it takes the sand-like particles 82 to be completely discharged from the upper chamber 74 of timer 70 through the orifice 76 into the lower chamber 72. Yet a further object of the game is to score as many points as possible by controlling the orientation of a game piece 10 in the stack. Each game piece possesses at least two balancing surfaces. Therefore, to stack a first game piece on top of a second game piece a balancing surface of the first game piece is made to rest on a balancing surface of the second game piece so that the first game piece balances on the second game piece. The game rules described below refer to the preferred embodiment. However, other rules may be applied in playing the game of the present invention.

In the preferred embodiment there are five prism-shaped game pieces 10, each of which possesses at least two balancing surfaces and a glow-in-the-dark feature. There is also a timer 70 which also possesses a glow-in-the-dark feature. The timer 70 is designed such that when the sand-like particles 82 contained within the upper chamber 74 of the timer 70 have been completely exhausted into the lower chamber 72 of the timer 70 approximately 90 seconds has transpired. To ensure consistency in quality of game play, it is preferred that a level, sturdy surface be used. The game pieces 10 are stacked and balance one atop the other, thus forming a stack.

In the preferred embodiment, to score any points at all, two conditions must be met. First, the stack must contain at least two game pieces. Second, the stack must be complete and standing before the 90 seconds as marked by the timer are up. Different point values may be awarded based on how one game piece is stacked and balanced on top of another game piece. For example, if the base of a game piece is balanced on the apex of a second game piece where the longitudinal axes of both game pieces are in alignment, one point score would then be allowed for such a configuration. An alternate configuration would be to balance the base of one game piece on the apex of a second game piece such that the longitudinal axes of the two game pieces are aligned at approximately 90 degrees to each other. A different point total would then be allowed for this configuration. Furthermore, every time two game pieces are stacked crosswise with the upper game piece having its apex balanced on the apex of the lower game piece bonus points may be scored. Additionally, when the game is played in a darkened room, all point scores may be increased or even doubled. The first person or team to score a predetermined total number of points wins the game.

Figure 8:
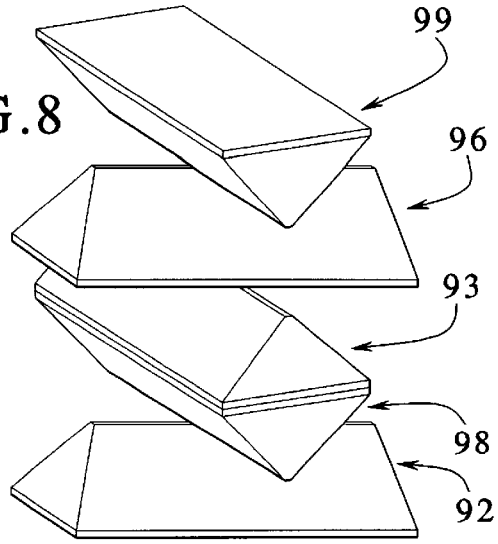
FIG. 8 is a schematic depicting the scoring used in accordance with the principles of the present invention.

FIG. 8 depicts scoring in the preferred embodiment. With the game pieces stacked as shown by positions 98, 99, 100 points, for example, may be scored. With the game pieces stacked as shown by positions 92, 93, 25 points, for example, may be scored. Stacking a game piece as shown by position 96, for example my result in a score of 50 points.

Thus it has been disclosed in the preferred embodiment of the present invention a game of balance and dexterity and rules for playing such a game. Although not limited to a specified number of pieces or to pieces of a singular size or shape, the game of the present invention is described below in terms of a specific game with a specific set of rules. However, the game pieces and rules can be varied without exceeding the principles of the invention embodied in this disclosure. Other embodiments to increase or decrease the challenge can be easily envisioned within the basic principles of the present invention.

What is claimed is:

1. A method of playing a stacking game comprising the steps of:

providing a plurality of glow-in-the-dark prism-shaped game pieces, each game piece having at least a first balancing surface and a second balancing surface;

providing a glow-in-the-dark game timer, the game timer providing means to measure an elapsed time in a darkened room;

stacking the first or second balancing surface of a first game piece on the first or second balancing surface of a second game piece and thereby balancing the first game piece on the second game piece thus forming a stack having a topmost game piece with each game piece having an orientation with respect to every other game piece; and continuing to stack the first or second balancing surface of additional game pieces on the first or second balancing surface of the topmost game piece in the stack until the stack collapses or the elapsed time has occurred; and awarding points to a player based on the number of game pieces in the stack.

2. The method of claim 1 further wherein the step of awarding points further comprises awarding points based on the orientation of each game piece.

3. The method of claim 1 further wherein the step of awarding points further comprises awarding points based on the game being played in a darkened room.

4. A method for increasing or decreasing a skill level required to stack and balance glow-in-the-dark game pieces possessing at least two balancing surfaces comprising:

increasing the size of the balancing surface to decrease the required skill level;

decreasing the size of the balancing surface to increase the required skill level;

playing the game in a well-lit room to decrease the required skill level;

playing the game in a darkened room to increase the required skill level; and limiting the amount of time which is allowed to stack the game pieces to increase the required skill level.

5. The method of claim 4 wherein the balancing surface is an apex of a truncated prism.

6. The method of claim 5 wherein the size is increased by increasing the width of the apex.

7. The method of claim 4 wherein the balancing surface is a base of a truncated prism.

* * * * *